US012349753B2

(12) United States Patent
Martin et al.

(10) Patent No.: US 12,349,753 B2
(45) Date of Patent: Jul. 8, 2025

(54) JACKET WITH DETACHABLE HOOD

(71) Applicant: KUIU, LLC, Dixon, CA (US)

(72) Inventors: Nicolas Martin, Rio Linda, CA (US); Rebecca Willis, Woodland, CA (US)

(73) Assignee: KUIU, LLC, Dixon, CA (US)

( * ) Notice: Subject to any disclaimer, the term of this patent is extended or adjusted under 35 U.S.C. 154(b) by 0 days.

(21) Appl. No.: 17/854,708

(22) Filed: Jun. 30, 2022

(65) Prior Publication Data

US 2024/0000178 A1 Jan. 4, 2024

(51) Int. Cl.

| | |
|---|---|
| ***A42B 1/048*** | (2021.01) |
| ***A41D 3/00*** | (2006.01) |
| ***A41F 1/00*** | (2006.01) |

(52) U.S. Cl.

CPC ..... *A42B 1/048* (2013.01); *A41D 3/005* (2013.01); *A41F 1/002* (2013.01); *A41D 2200/20* (2013.01)

(58) Field of Classification Search

CPC A42B 1/048; A41D 2200/20; A41D 2400/70; A41F 1/002

See application file for complete search history.

(56) References Cited

U.S. PATENT DOCUMENTS 2,102,251 A * 12/1937 Arst ..... A41D 3/00 2/84
2,370,158 A * 2/1945 Freedman ..... A41D 3/04 2/84
2,372,110 A * 3/1945 Noone ..... A41D 3/08 5/413 R
2,439,382 A * 4/1948 De Grazla ..... A42B 1/048 2/84
3,161,932 A * 12/1964 Anne ..... A41F 1/002 24/303
5,274,850 A * 1/1994 Aldridge ..... A62B 17/003 2/202
5,369,809 A * 12/1994 Hall ..... A41D 3/00 2/202
5,604,960 A * 2/1997 Good ..... A41F 1/002 24/66.1
6,023,787 A * 2/2000 French ..... A42B 1/048 2/202
6,374,418 B1 * 4/2002 Rindle ..... A42B 1/048 2/202
6,412,116 B1 * 7/2002 Clark ..... A45D 44/08 2/129

(Continued)

FOREIGN PATENT DOCUMENTS

EP 1867243 A2 12/2007

OTHER PUBLICATIONS

European Search Report for EP 23179838.8, dated Feb. 5, 2025.

*Primary Examiner* — Heather Mangine
(74) *Attorney, Agent, or Firm* — DORSEY & WHITNEY LLP

(57) ABSTRACT

A detachable hood for a jacket can include a top dome portion, a back portion connected to the top dome portion, and a first side portion connected to the top dome portion and the back portion. In addition, the detachable hood can include a second side portion opposing the first side portion, the second side portion connected to the top dome portion and the back portion. Further, the detachable hood can include a collar extending from each of the first side portion and the second side portion, where the collar includes a magnetic connector.

20 Claims, 11 Drawing Sheets

(56) References Cited

U.S. PATENT DOCUMENTS 6,654,963 B2 * 12/2003 Fayle ..... A41D 3/00 2/84
7,086,092 B1 * 8/2006 Cruz ..... A41F 1/002 2/132
D783,233 S * 4/2017 Steel ..... D2/831
9,993,042 B1 * 6/2018 Miller ..... A42B 1/048
2002/0192284 A1 12/2002 Moroni et al.
2004/0055069 A1 * 3/2004 Clarke Fayle ..... A41D 3/00 2/93
2004/0143880 A1 * 7/2004 Clark ..... A41D 3/00 2/69
2005/0241045 A1 * 11/2005 Tolton ..... A42B 1/048 2/84
2008/0201821 A1 8/2008 Bryant
2009/0151055 A1 * 6/2009 Duncan ..... A62B 17/04 2/205
2009/0241236 A1 * 10/2009 Rotheram ..... A41D 1/002 2/84
2010/0064417 A1 * 3/2010 Fruge ..... A42B 1/046 2/202
2011/0179548 A1 * 7/2011 Weston ..... A45F 4/14 2/84
2013/0031695 A1 * 2/2013 Roemer ..... A41D 3/00 2/84
2014/0317829 A1 * 10/2014 Rolfe ..... A41D 3/00 2/202
2014/0338093 A1 11/2014 Gersten et al.
2015/0013046 A1 * 1/2015 Coleman ..... A42B 1/048 2/202
2015/0201693 A1 * 7/2015 Donner ..... A42B 1/048 2/204
2015/0208747 A1 * 7/2015 Barrett ..... A42B 1/048 2/84
2015/0327612 A1 * 11/2015 Bublitz ..... A41D 15/005 2/202
2016/0150847 A1 * 6/2016 Johnson ..... A42C 5/04 2/202
2017/0127813 A1 * 5/2017 Calman ..... A45C 11/36
2018/0042319 A1 * 2/2018 Fowler ..... A41D 3/00
2018/0049499 A1 * 2/2018 Noll ..... A42B 1/0186
2018/0064190 A1 * 3/2018 Khan ..... A42B 1/048
2018/0177248 A1 * 6/2018 Sneath ..... A41D 3/00
2018/0271189 A1 * 9/2018 Hussey ..... A41D 13/012
2018/0271196 A1 * 9/2018 Hussey ..... A42B 1/048
2019/0060724 A1 * 2/2019 Farina ..... A63B 57/60
2019/0069620 A1 3/2019 Davis et al.
2019/0104775 A1 * 4/2019 Wood ..... A41D 3/00
2019/0261718 A1 * 8/2019 O'Connor ..... A41D 3/02
2020/0253296 A1 * 8/2020 Washio ..... A42B 1/247
2020/0383399 A1 * 12/2020 Rizk ..... A41D 3/00
2021/0037904 A1 * 2/2021 MacFarlane ..... A41F 1/002
2021/0052059 A1 * 2/2021 McMillan, II ..... H04B 1/3888
2021/0186136 A1 * 6/2021 Romano ..... A42B 1/048
2021/0345700 A1 * 11/2021 Krulik ..... A47K 5/1211
2022/0007767 A1 * 1/2022 Harris ..... A41F 1/002
2022/0015465 A1 * 1/2022 Dickson ..... A41D 3/02
2022/0117379 A1 * 4/2022 Landry-Savard ..... A45D 44/08
2022/0192284 A1 6/2022 Chen
2022/0322776 A1 * 10/2022 Hagler ..... A41F 1/002
2022/0369744 A1 * 11/2022 York ..... A41D 13/00
2023/0000180 A1 * 1/2023 Buzzini ..... A41D 27/20

* cited by examiner

JACKET WITH DETACHABLE HOOD

FIELD

The described embodiments relate generally to clothing or outerwear. In particular embodiments, the disclosure relates to a jacket with a detachable hood.

BACKGROUND

Clothing and outerwear is a common aspect of outdoor adventurers, including hunters. For example, coats and jackets are often a user's first defense against the natural elements—including cold temperatures, snow, wind, rain, hail, etc. In addition, coats and jackets are often camouflaged to help visually conceal a user.

Unfortunately, however, many coats and jackets are not suitable for close proximity hunting. Close proximity hunting can be defined as positioning a hunter within (or anticipating a position within) a hundred yards or less of an animal. Close proximity hunting can include hunting from a tree stand or blind. In other cases, close proximity hunting involves utilizing surrounding elements for concealment (e.g., the ground, grass, brush, rocks, or trees). Close proximity hunting can apply to spot-and-stalk hunters that first find a big game animal and then quietly and carefully pursue the animal. Close proximity hunting can also apply to hunters that wait at a certain location, thereby leveraging patience and (ideally) silence in a still, undisturbed environment. This close proximity type of hunting is often associated with archery hunting and muzzleloader hunting. However, rifle hunting can also employ close proximity hunting and associated strategy.

In close range to big game (e.g., elk, deer, antelope, etc.), a variety of clothing factors in addition to visibility come into play—namely scent and sound. Big game animals are generally extremely sensitive to scents and/or sounds. Indeed, at the slightest hint of a human presence, big game animals will often quickly leave the area—closing nearly all opportunity of a successful harvest at that particular time.

For at least this reason, many coats and jackets are not suitable for close proximity hunting. Indeed, normal use and wear of conventional coats and jackets produce too much noise. For example, some conventional coats and jackets include a material that makes an audible woosh or swish when brushing past elements like a bush or groundfall (or even another portion of the jacket). As another example, some conventional coats and jackets are not easily adjusted or modified on the fly, especially in a convenient, noiseless manner while in close proximity to big game. As yet another example, certain conventional coats and jackets are too bulky and cumbersome to use effectively while archery hunting (e.g., to draw and shoot an archery bow).

The subject matter claimed herein is not limited to embodiments that solve any disadvantages or that operate only in environments such as those described above. Rather, this background is only provided to illustrate one example technology area where some embodiments described herein may be practiced.

SUMMARY

An aspect of the present disclosure relates to a detachable hood for a jacket. In some embodiments, the detachable hood includes a top dome portion, a back portion connected to the top dome portion, and a first side portion connected to the top dome portion and the back portion. In addition, the detachable hood can include a second side portion opposing the first side portion, the second side portion connected to the top dome portion and the back portion. Further, the detachable hood can include a collar extending from each of the first side portion and the second side portion, the collar comprising a magnetic connector.

In some embodiments, the collar includes an outer surface layer and an inner surface layer opposing the outer surface layer, the magnetic connector being embedded in the collar between the outer surface layer and the inner surface layer. In one or more embodiments, the collar includes a middle layer disposed between the outer surface layer and the inner surface layer. In particular embodiments, the magnetic connector is positioned: between the outer surface layer and the middle layer; or between the inner surface layer and the middle layer. In certain implementations, the collar includes an additional magnetic connector positioned between the inner surface layer and the middle layer, and the magnetic connector is positioned between the outer surface layer and the middle layer.

In one or more embodiments, the collar includes an additional magnetic connector positioned at a first end of the collar, and the magnetic connector is positioned at a second end of the collar opposite the first end. In some embodiments, the collar includes a plurality of magnetic connectors spaced equidistant from each other.

In certain embodiments, the first side portion includes a first side periphery; the second side portion includes a second side periphery; and the first side periphery and the second side periphery define and adjustable hood tunnel. In some embodiments, the detachable hood includes an adjustment mechanism positioned at the back portion or the top dome portion, and a drawstring connecting the first side periphery and the second side periphery to the adjustment mechanism. In one or more embodiments, the adjustable hood tunnel forms a first eye relief distance when the drawstring and adjustment mechanism are configured in a non-drawn state. Additionally, in some embodiments, the adjustable hood tunnel forms a second eye relief distance greater than the first eye relief distance when the drawstring and adjustment mechanism are configured in a drawn state.

Another aspect of the present disclosure relates to a jacket. In some embodiments, the jacket includes a body portion, a jacket collar connected to the body portion, and a hood removably attached to the jacket collar inside a connection sleeve opening. The jacket collar can include a first magnetic connector and the connection sleeve opening defined by a first sleeve side and a second sleeve side opposing the first sleeve side. In some embodiments, the hood includes a top dome portion, a back portion connected to the top dome portion, and a side portion connected to the top dome portion and the back portion. Further, in some embodiments, the hood includes a hood collar extending from the side portion, the hood collar comprising a second magnetic connector coupled to the first magnetic connector.

In certain embodiments, the first magnetic connector is embedded in the first sleeve side. In one or more embodiments, the jacket collar further includes a third magnetic connector embedded between layers composing the second sleeve side, the third magnetic connector being positionally offset relative to the first magnetic connector and the second magnetic connector. In some embodiments, the hood collar includes a first layer and a second layer. In particular embodiments, the second magnetic connector abuts the first layer of the hood collar; the hood collar further includes a fourth magnetic connector abutting the second layer of the hood collar, the fourth magnetic connector being positioned to align with the third magnetic connector; and the fourth magnetic connector is coupled to the third magnetic connector. In at least some embodiments, the first sleeve side conceals a coupling of the first magnetic connector and the second magnetic connector.

Yet another aspect of the present disclosure relates to a jacket. The jacket can include a jacket body that includes a first magnetic connector, and a detachable hood that includes a second magnetic connector removably coupled to the first magnetic connector of the jacket body. In some embodiments, the jacket body and the detachable hood include a quiet material comprising at least one of wool, fleece, or polyester. In some embodiments, the first magnetic connector and the second magnetic connector are configured for decoupling using a single-handed pulling motion. In one or more embodiments, the jacket body includes a zipper extending from a jacket body top area to a jacket body bottom area, the first magnetic connector being positioned adjacent to the zipper at the jacket body top area. In certain embodiments, the detachable hood comprises a hood flap configured to superimpose over a portion of the jacket body top area, the second magnetic connector being positioned on or within the hood flap.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
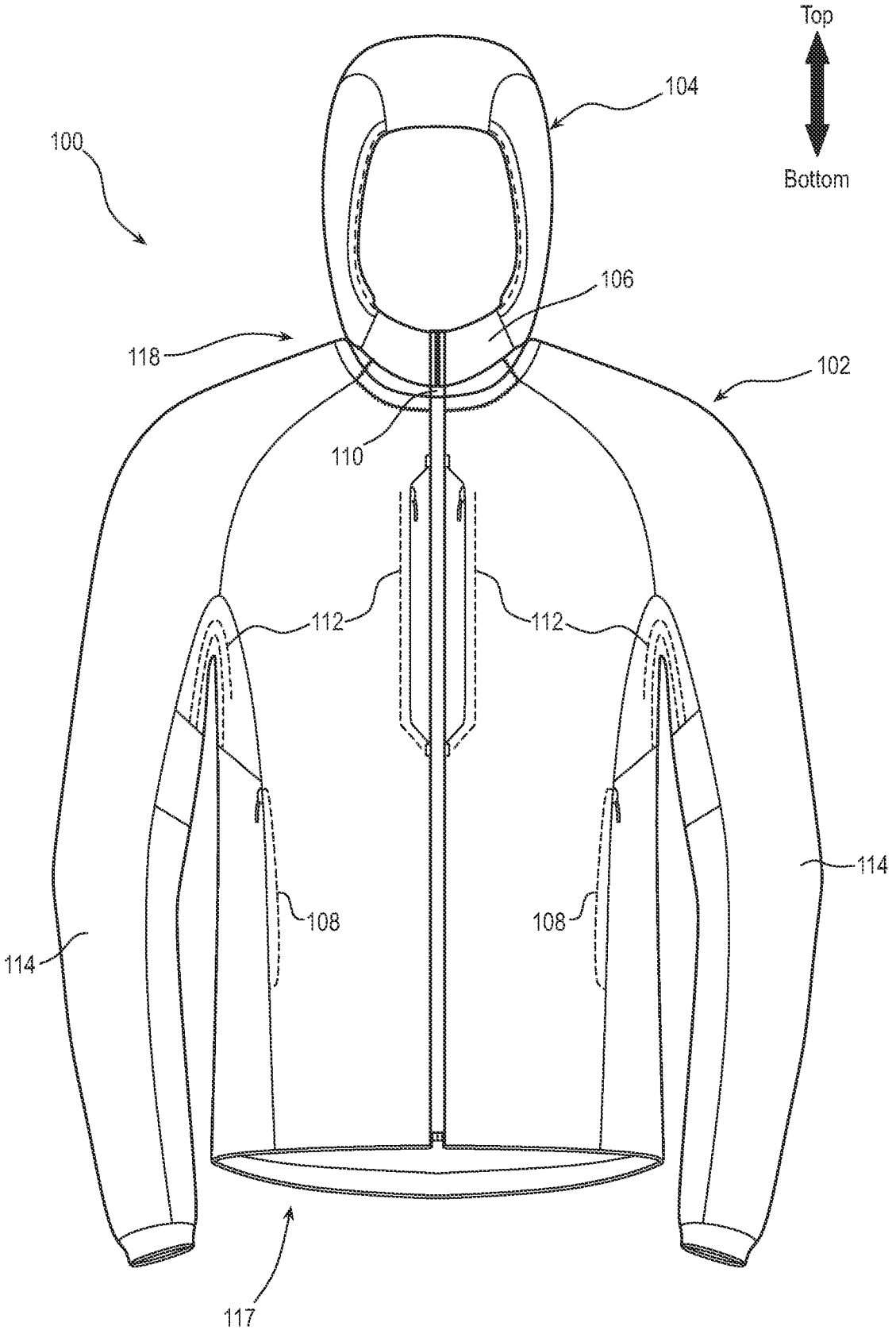
FIG. 1 illustrates a front assembled view of an example jacket.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a jacket. In one example, a jacket includes a variety of different outerwear. For example, a jacket can include a sleeved jacket, sleeveless jacket (e.g., vest), zipper jacket, pullover, coat, parka, windbreaker, rainwear, sweater, hoodie, etc. Indeed, a jacket of the present disclosure can correspond to myriad different shapes, configurations, materials, and use-cases. In at least some embodiments, the jacket includes one or more layers of quiet material (e.g., wool, fleece, polyester, etc.) that do not produce audible noise during use, movement, or physical contact—which can be advantageous for close proximity hunting situations.

In particular embodiments, the jacket includes a removable hood. In one example, the removable hood and the jacket are removably attached via one or more quiet attachment mechanisms (e.g., that couple and decouple under a threshold number of decibels). These quiet attachment mechanisms can be particularly advantageous in close proximity hunting situations because some big game are sensitive to sounds. For instance, in one or more embodiments, the removable hood and the jacket are removably attached via a magnet or clasp. Additionally or alternatively, the removable hood and the jacket are removably attached via a VELCRO® strip, button, zipper, snap, etc.

In some embodiments, the removable hood can couple (and decouple) the jacket utilizing predetermined ergonomics or convenient motions. For example, the removable hood is detachable from the jacket via a single-handed pulling motion. As another example, the removable hood can detach from the jacket by grabbing the hood and (without further hand movement) shifting the user's head to create a fulcrum effect and impart sufficient tension that quietly pops the removable hood free of the jacket. In yet another example, the removable hood is attachable to the jacket by positioning a collar flap of the removable hood in close proximity to a jacket collar (e.g., to engage corresponding magnets).

It will be appreciated that such ergonomics can facilitate in-use jacket adjustments (i.e., adjustments while the jacket is being worn). This can be particularly advantageous because often times hunters do not have both hands readily available. Rather, a hunter may carry a bow, rifle, or pair of binoculars in one hand-thereby preventing use of both hands to manipulate or modify the jacket. Sometimes, even a hunter's position (e.g., the prone position) can thwart two-handed functions. Further, and in many cases, more movement (e.g., from multi-hand adjustment) can be less ideal in close proximity to big game. That is, more movement (or bigger ranges of motion) typically leads to more opportunity for creating noise or being seen—both disadvantages in hunting. Accordingly, certain implementations of the disclosed jacket allow single-handed manipulation, or even just a pair of fingers to discretely and quietly perform an adjustment task like removing the hood from off the jacket or pulling the drawstring to increase an eye relief distance.

In one or more embodiments, the removable hood of the present disclosure includes one or more components for eye relief distance adjustment (e.g., to modify the distance measured from the user eye to a side periphery of the removable hood). For example, side portions of the removable hood define an adjustable hood tunnel where an eye relief distance can be tuned utilizing an adjustment mechanism and drawstring. From a non-drawn state, the drawstring and adjustment mechanism can be manipulated (e.g., pulled, retracted, etc.) to the drawn state, thereby forming an increased eye relief distance compared to that of the non-drawn state.

It will be appreciated that a greater eye relief distance can increase a field of view of a user when the removable hood is donned. Additionally, a greater eye relief distance can help the removable hood from inhibiting a user interacting with an optic device, firearm, or bow component brought in close proximity to the user eye. For instance, with the removable hood in the drawn state, the greater eye relief distance can allow a user to bring a bow string in intimate contact with a side of the user's face for alignment with a peep sight on the bow string. Unlike conventional jackets that would interfere with the bow string in this position, the disclosed jacket with a removable hood does not interfere. Indeed, conventional jackets typically adjust from a normal field of view to a restricted field of view by contracting a hood opening. By contrast, the adjustable hood tunnel of the removable hood can provide an increased field of view and, in turn, increased user flexibility for wear during myriad different hunting situations or other applications.

These and other embodiments are discussed below with reference to FIGS. 1-11J. However, those skilled in the art will readily appreciate that the detailed description given herein with respect to these Figures is for explanatory purposes only and should not be construed as limiting. Furthermore, as used herein, a system, a method, an article, a component, a feature, or a sub-feature including at least one of a first option, a second option, or a third option should be understood as referring to a system, a method, an article, a component, a feature, or a sub-feature that can include one of each listed option (e.g., only one of the first option, only one of the second option, or only one of the third option), multiple of a single listed option (e.g., two or more of the first option), two options simultaneously (e.g., one of the first option and one of the second option), or combination thereof (e.g., two of the first option and one of the second option).

Figure 2:
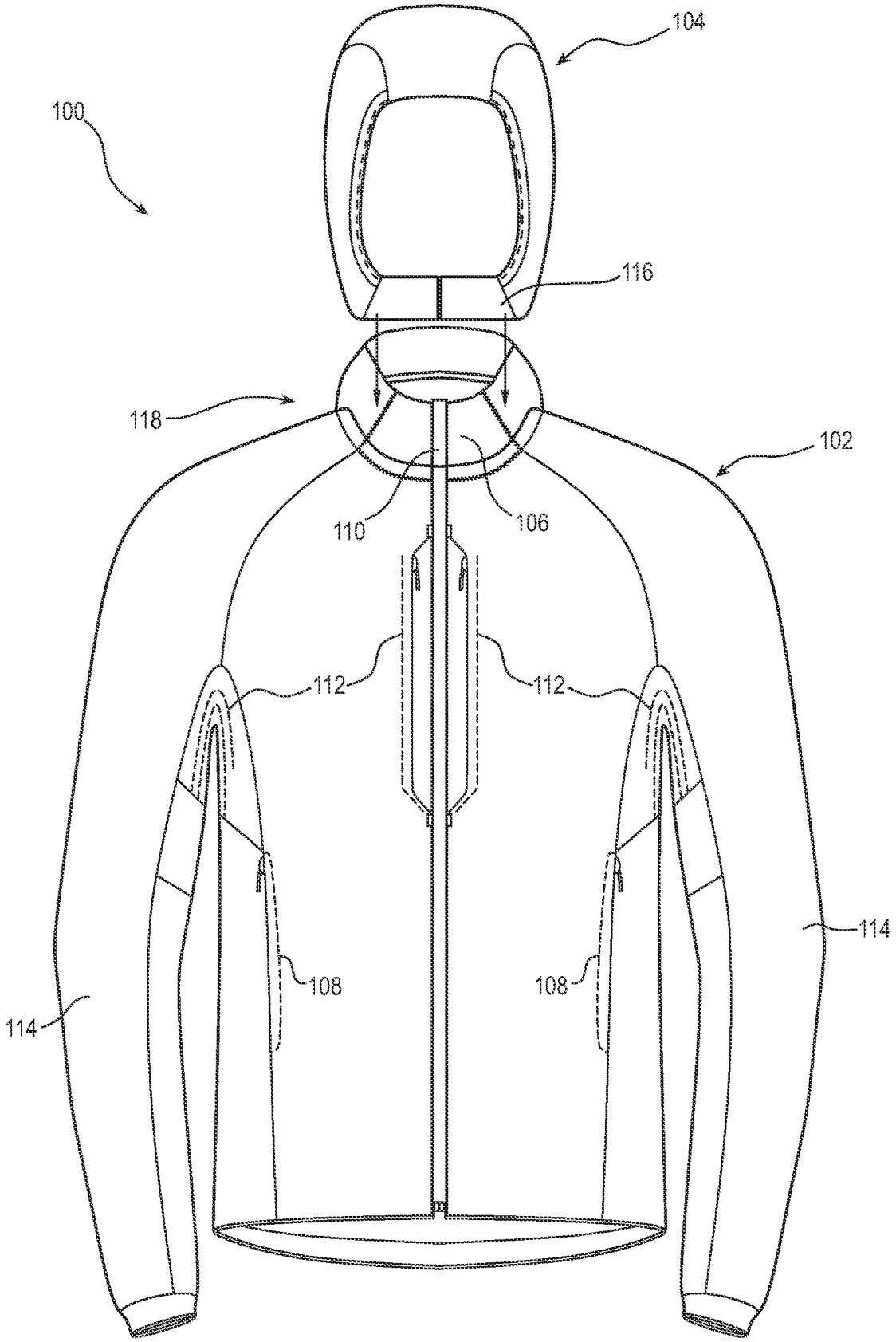
FIG. 2 illustrates a front exploded view of an example jacket.

FIGS. 1-2 respectively illustrate a front assembled view and a front exploded view of an example jacket 100. As shown, the jacket 100 includes a variety of different components and features. In particular, the jacket 100 includes a jacket body 102. The jacket body 102 can include, among other things, pockets 108, a zipper 110, vents 112, and sleeves 114. Each is discussed in turn.

The pockets 108 can be sized and shaped for a user hand. In a similar vein, the pockets 108 can be positioned along an outer surface of the jacket 100 to receive a user hand. For instance, the pockets 108 are positioned closer to a bottom end portion 117 than a top end portion 118 of the jacket 100.

In one or more embodiments, the pockets 108 include other features. For example, the pockets 108 includes an internal pocket (not shown) that is sized and shaped to receive a warming element (e.g., a hand-warmer pouch or heat pad device). Additionally or alternatively, in certain embodiments, the internal pocket within the pockets 108 comprises an orientation that is configured to retain a warming element, but not retain other items. For example, the internal pocket within the pockets 108 can be oriented in an angled direction (e.g., horizontal) such that elements outside of the internal pocket can be readily accessible when a user inserts a hand into one of the pockets 108 (e.g., to retrieve a phone, key, knife, cartridge, primer, diaphragm call, etc.). Indeed, with an angled orientation, a user can be less likely to incidentally retrieve the warming element positioned within the internal pocket of the pockets 108. Likewise, with an angled orientation, a user can be less likely to incidentally place a non-warming element inside the internal pocket of the pockets 108. In this manner, the internal pocket within the pockets 108 can increase a functionality and storage use of the jacket 100, but without added pocket complexity lending to a poor user experience.

As also mentioned above, the jacket body 102 includes the zipper 110. As indicated in FIGS. 1-2, the zipper 110 is a full zipper, extending from the bottom end portion 117 to the top end portion 118. It will be appreciated, however, that the jacket body 102 can include different versions of the zipper 110 (e.g., half-zip, quarter-zip, etc.). Still, in other embodiments, the jacket body 102 includes no front zipper.

Further, the jacket body 102 includes the vents 112. The vents 112 are defined by surfaces or layers of the jacket body 102 forming an opening (or openable region). In one or more embodiments, the vents 112 are positioned in portions of the jacket 100 associated with bodily heat production. For example, as shown, the vents 112 are positioned proximate to the zipper 110 in a chest region. Further, the vents 112 are positioned in an armpit region of the sleeves 114. It will be appreciated that regulating body temperature (e.g., via the vents 112) can help to avoid user sweating due to body exertion and/or changing weather conditions. Additional or alternative vents are also herein contemplated.

In addition, the jacket body 102 includes a jacket collar 106. In some embodiments, the jacket collar 106 includes a region of the jacket 100 at the top end portion 118 adjacent to the zipper 110. Additionally, albeit not shown, the jacket collar 106 can circumnavigate around the top end portion 118 (e.g., to protect a neck region of a user). In particular embodiments, the jacket collar 106 connects with a detachable hood 104. For example, in some embodiments, the jacket body 102 and the detachable hood 104 are removably attached to each other via the jacket collar 106 and a hood collar 116 (e.g., as indicated in FIG. 2). To illustrate, in certain implementations, the hood collar 116 includes a hood flap configured to superimpose over (and connect with) a portion of the top end portion 118, including the jacket collar 106. Additionally or alternatively, the jacket body 102 and the detachable hood 104 are removably attached to each other via portions other than the jacket collar 106 and the hood collar 116. For instance, the jacket body 102 and the detachable hood 104 are removably attached at a backside of the jacket 100 (e.g., where the jacket body 102 and the detachable hood 104 overlap).

In certain embodiments, the jacket collar 106 and the hood collar 116 couple the jacket body 102 and the detachable hood 104 together via quiet attachment mechanisms. That is, quite attachment mechanisms can be positioned on or between layers of the jacket collar 106 and the hood collar 116 to facilitate quiet coupling (and decoupling) of the jacket body 102 and the detachable hood 104. Such quiet attachment mechanisms can include elements that couple and/or decouple under a threshold decibel level (or within a threshold range of decibels). For instance, quiet attachment mechanisms can include elements that couple and/or decouple from a corresponding quiet attachment mechanism in a manner under about fifty decibels, under about forty decibels, under about thirty decibels, or under about twenty decibels. As another example, quiet attachment mechanisms can include elements that couple and/or decouple from a corresponding quiet attachment mechanism in a manner that ranges from about five decibels to about sixty decibels, from about ten decibels to about thirty decibels, or from about fifteen decibels to twenty-five decibels.

In at least some embodiments, quiet attachment mechanisms include magnets. The quiet attachment mechanisms can also include other mechanisms (alone or with noise-reducing modifications) like brooches, buttons, buckles, clasps, eyelets, fabric ties, frog closures, grommets, hook and eyes, laces, loop fasteners, pins, poppers, press studs, snap fasteners, toggles, hook and loop VELCRO® tape, zippers, etc. Examples of noise-reducing modifications can include added material, coatings, dampeners, etc.

These and/or other features of the jacket 100 are described in further detail below. In particular, the below figures provide additional detail of the removability (and integration) between the detachable hood 104 and the jacket body 102.

Any of the features, components, and/or parts, including the arrangements and configurations thereof shown in FIGS. 1-2 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 1-2.

Figure 3:
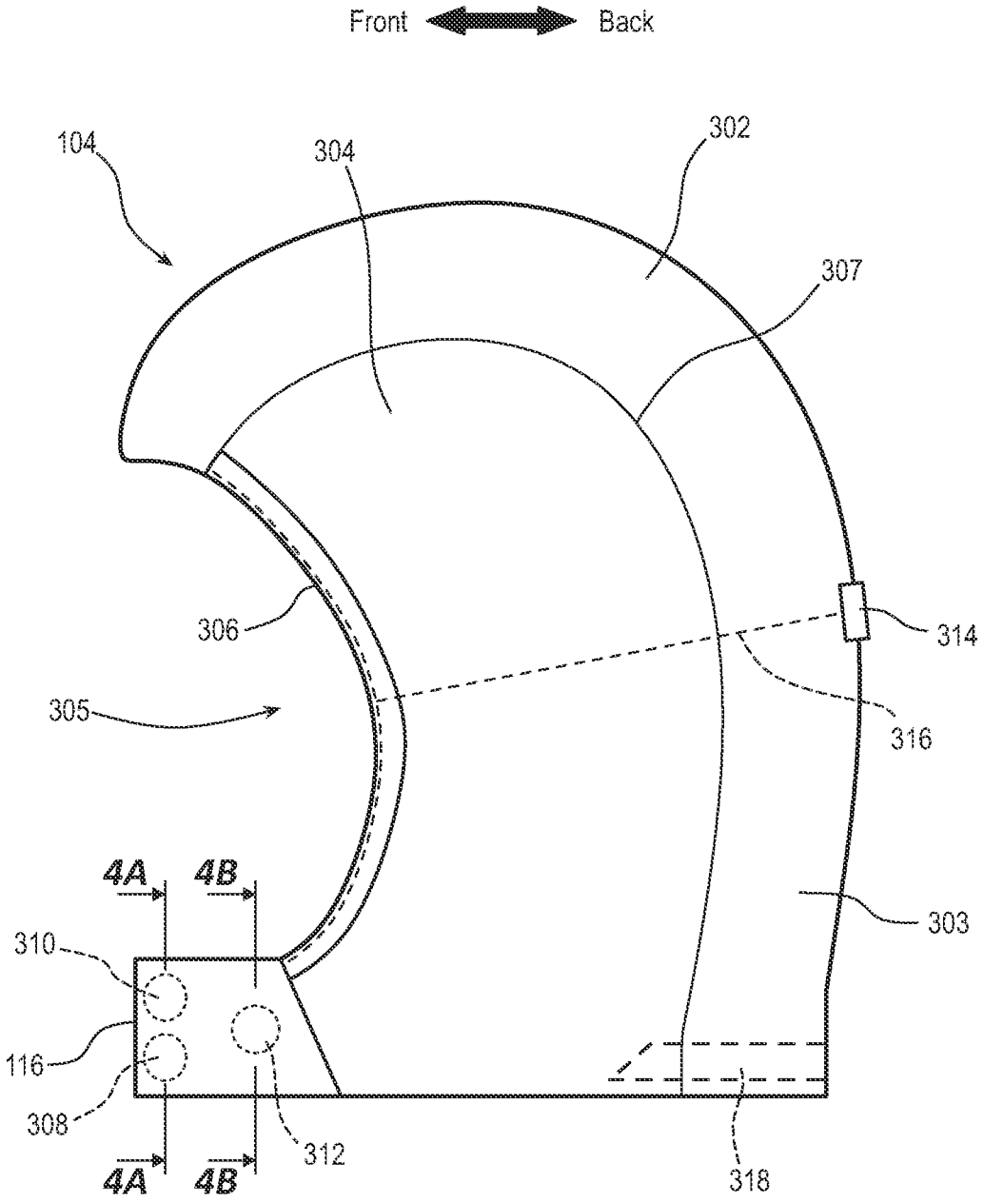
FIG. 3 illustrates a side view of an example detachable hood.

As just described, the detachable hood 104 can include a variety of features, including quiet attachment mechanisms. In accordance with one or more such embodiments, FIG. 3 illustrates a side view of an example of the detachable hood 104. In particular, FIG. 3 illustrates the detachable hood 104 including a top dome portion 302, a back portion 303, and a side portion 304 in relation to the hood collar 116. Each is discussed in turn.

The top dome portion 302 includes a top-most region of the detachable hood 104. In particular embodiments, the top dome portion 302 is configured to cover an upper portion of a user head. For example, the top dome portion 302 can cover one or more portions of a head crown, a mid-scalp region between user ears, or a forward scalp region in front of the user ears. As another example, the top dome portion 302 can cover at least a portion of a user forehead. In yet another example, the top dome portion 302 extends above an adjustment mechanism 314 and a drawstring 316 between a side portion boundary 307 and an opposing side portion boundary (not illustrated). That is, in certain embodiments, the top dome portion 302 adjoins or is connected to the back portion 303 at or near the adjustment mechanism 314 and along the drawstring 316. Still further, the top dome portion 302 can adjoin or be connected to the side portion 304 at or near the side portion boundary 307.

The back portion 303 includes a back region of the detachable hood 104. In particular embodiments, the back portion 303 is configured to cover a back of a user head. For example, the back portion 303 can cover a one more portions of a head crown and below (e.g., down to a user neck). As another example, the back portion 303 can cover a portion of a user head behind the user ears. In particular embodiments, the back portion 303 extends down from the adjustment mechanism 314 and the drawstring 316 between the side portion boundary 307 and the opposing side portion boundary (not illustrated).

The side portion 304 includes a side region of the detachable hood 104. In particular embodiments, the side portion 304 is configured to cover a portion of a user face. For example, the side portion 304 can cover a side of a user face, such as one or more portions of a temple, ear, cheek, or jaw region. As another example, the side portion 304 can cover a portion of a side scalp region adjacent to a user ear. In yet another example, the side portion 304 can cover a portion of a neck region. In particular embodiments, the side portion 304 extends between a side periphery 306 and the side portion boundary 307.

In one or more embodiments, the side periphery 306 corresponds to an edge of the side portion 304 (e.g., at a forward-most portion of the side portion 304). In particular embodiments, the side periphery 306 includes a curved edge of the detachable hood 104. To illustrate, the side periphery 306 includes a curved edge in the detachable hood 104 defining a carve-out or hood tunnel 305 in the detachable hood 104 (e.g., for improved field of view compared to straight-edge hoods). Further, as will be described below in relation to FIGS. 10A-10B, the side periphery 306 can be adjusted to modify the hood tunnel 305 (e.g., to provide an increased field of view or an increased eye relief distance). Specifically, the side periphery 306 can be modified utilizing the adjustment mechanism 314 and the drawstring 316 to adjust between drawn and non-drawn states where the adjustable hood tunnel 305 is respectively accentuated and relaxed.

With respect to the side portion boundary 307, the side portion boundary 307 can include various different types of boundaries. For instance, in some embodiments, the side portion boundary 307 includes a physical joint, seam, or stitching of hood materials. In other embodiments, the side portion boundary 307 includes an aesthetic element or design stitching (e.g., without a joining of hood materials). Further, in some embodiments, the side portion boundary 307 is merely a line of reference for discussing relative positioning of the various regions of the detachable hood 104, in which case the side portion boundary 307 includes no physical boundary or visible line.

Additionally shown in FIG. 3, the detachable hood 104 includes the hood collar 116. In one or more embodiments, the hood collar 116 extends from the side portion 304. For example, the hood collar 116 abuts a lower portion of the side periphery 306 and extends frontward away from the side portion 304. As another example, the hood collar 116 defines a bottom end of the adjustable hood tunnel 305.

In particular embodiments, the hood collar 116 connects the detachable hood 104 to the jacket body 102. Accordingly, certain implementations of the hood collar 116 include one or more quiet attachment mechanisms. For example, the hood collar 116 includes magnets 308-312. As shown in FIG. 3, the magnets 308-310 are positioned frontward of the magnet 312. In addition, the magnets 308-310 correspond to an outer surface of the hood collar 116. In contrast, the magnet 312 corresponds to an inner surface of the hood collar 116. The particular positioning of the magnets 308-312 within the hood collar 116 is further described below in relation to FIGS. 4A-4B.

In particular embodiments, however, the magnets 308-312 include a positional arrangement conducive for certain user ergonomics when coupling and/or decoupling the magnets 308-312. For example, in some embodiments, the magnets 308-312 include a positional arrangement such that the magnets 308-312 of the hood collar 116 can be coupled to and/or decoupled from corresponding magnets (or metallic elements) associated with the jacket collar 106 via a single user hand. As another example, the magnets 308-312 include a positional arrangement such that the magnets 308-312 of the hood collar 116 can be coupled and/or decoupled using a certain force profile, positional alignment, sequence of coupling, etc. The coupling/decoupling mechanics are described further below in relation to FIG. 7.

Although FIG. 3 illustrates the hood collar 116 including three magnets, alternative embodiments of the hood collar 116 can include more or fewer magnets. Similarly, the magnets 308-312 can include a variety of different shapes and sizes. Alternatively, as mentioned above, the hood collar 116 can include myriad different types of attachment mechanisms besides magnets.

Further shown in FIG. 3, the detachable hood 104 includes a zipper 318. In one or more embodiments, the zipper 318 can also connect the detachable hood 104 to the jacket body 102. For example, the zipper 318 is positioned at a base portion of the back portion 303 and/or the side portion 304. Here, at the base portion of the back portion 303 and/or the side portion 304, the detachable hood 104 is configured to overlap with the top end portion 118 at a backside of the jacket body 102. Alternatively to the zipper 318, the detachable hood 104 can include the same or similar fasteners discussed above for quiet attachment mechanisms.

In one or more embodiments, the detachable hood 104 includes a variety of different materials. In some embodiments, the detachable hood 104 includes a waterproof material (e.g., GORE-TEX®). In some embodiments, the detachable hood 104 includes an insulating material (e.g., down insulation, synthetic insulation). In particular embodiments, the detachable hood 104 includes a quiet material. A quiet material can include materials that are less prone to create audible noise when brought into contact with itself, another material, or another object. Some quiet materials include materials that generate noise on the same or similar scale of decibels as a quiet attachment mechanism (defined above). Examples of quiet materials can include wool (e.g., merino wool, sheep wool), fleece, polyester, and synthetic blends.

In certain embodiments, albeit not shown in FIG. 3, the detachable hood 104 can include one or more linings of material. To illustrate, for an outer lining embodiment, certain portions and/or features of the detachable hood 104 can be at least partially hidden, obscured, or covered. For example, an outer lining can cover one or more portions of the side portion boundary 307, the adjustment mechanism 314, the drawstring 316, and/or the zipper 318. As another example, an outer lining can cover one or more of the magnets 308-312. Those of ordinary skill in the art will appreciate that such linings can provide an aesthetic appeal. Additionally or alternatively, such linings can provide certain material structure(s) and/or functionality (e.g., wind or rain resistance, thermal insulation, etc.).

Any of the features, components, and/or parts, including the arrangements and configurations thereof shown in FIG. 3 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 3.

Figure 4A:
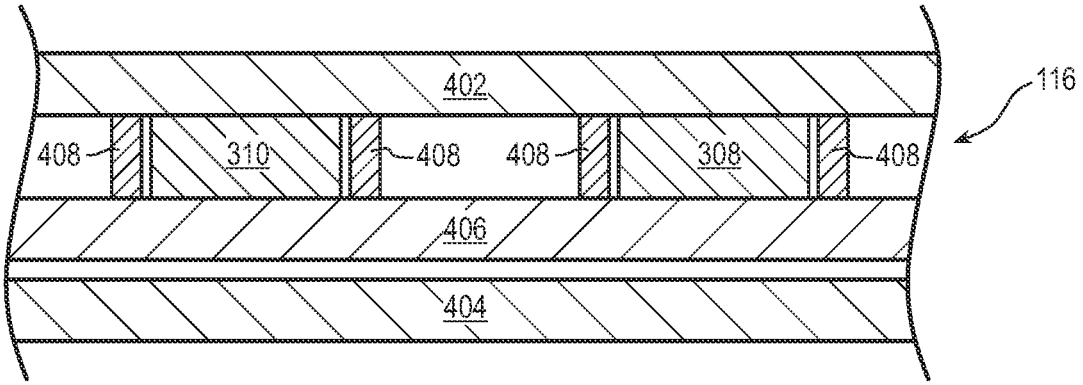
FIGS. 4A-4B illustrate cross-sectional views of an example hood collar.
Figure 4B:
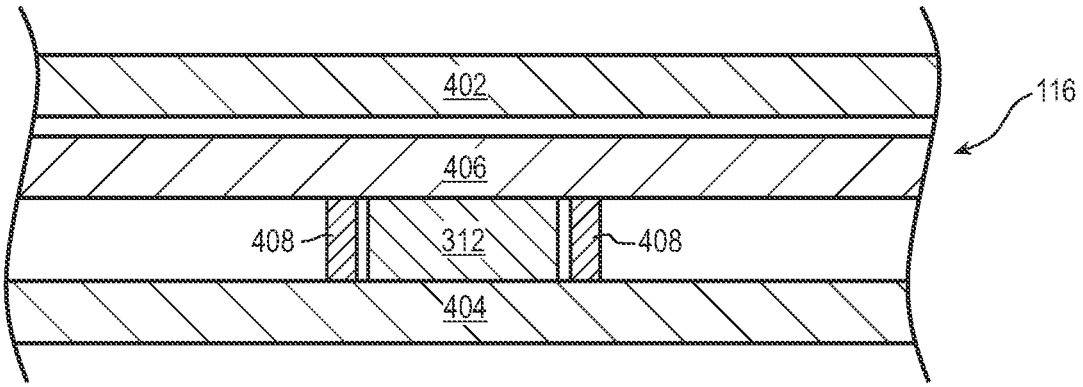

As mentioned above, the hood collar 116 can include magnets on or between layers composing the hood collar 116. In accordance with one or more such embodiments, FIGS. 4A-4B illustrate cross-sectional views of an example hood collar. In particular, FIG. 4A depicts a cross-section of the hood collar 116 in a plane that dissects the hood collar 116 perpendicular to the magnets 308-310.

In one or more embodiments, the magnets 308-310 are positioned between an outer surface layer 402 and an inner surface layer 404. In particular embodiments, the magnets 308-310 are positioned between the outer surface layer 402 and the inner surface layer 404 relative to a middle surface layer 406. For example, as depicted in FIG. 4A, the magnets 308-310 are positioned between the outer surface layer 402 and the middle surface layer 406. In particular embodiments, the magnets 308-310 abut the outer surface layer 402.

Further, in one or more embodiments, the magnets 308-310 are interspaced or offset relative to each other (e.g., for positioning at corner areas of the hood collar 116). However, one of ordinary skill in the art will appreciate that the magnets 308-310 can be positionally fixed or tuned to achieve myriad different spacing or positional offsets (e.g., subject to the spatial constraints of the jacket collar 106).

Other configurations of the magnets 308-310 at this particular cross-section are herein contemplated. For example, in some embodiments, the magnets 308-310 are positioned between the inner surface layer 404 and the middle surface layer 406. As another example, the magnets 308-310 are positioned between different layers. For instance, the magnet 308 is positioned between the outer surface layer 402 and the middle surface layer 406, while the magnet 310 is positioned between the inner surface layer 404 and the middle surface layer 406. Still, in other embodiments, the hood collar 116 includes only one of the magnets 308-310.

Further shown in FIG. 4A, the magnets 308-310 are maintained in position within the hood collar 116 via stitching 408. In some embodiments, the stitching 408 envelopes or surrounds the magnets 308-310. In this manner, the stitching 408 can help prevent the magnets 308-310 from moving around between layers, rearranging into another configuration, or mating together in direct contact. To illustrate, the stitching 408 helps maintain the magnets 308-310 in an offset position relative to each other and the magnet 312 (shown in FIG. 4B). For example, the magnets 308-310 can straddle the magnet 312 (shown in FIG. 4B).

Additionally or alternatively to the stitching 408, the hood collar 116 can include other forms of position management. For example, in some embodiments, the hood collar 116 includes a fabric seal (e.g., a thermoplastic bond or adhesive seal) encompassing the magnets 308-310 within a certain position. As another example, the hood collar 116 can include pockets, flaps, etc. to maintain a position of the magnets 308-310.

Similar to FIG. 4A, FIG. 4B illustrates a cross-section of the hood collar 116 in a plane that dissects the hood collar 116 perpendicular to the magnet 312. In one or more embodiments, the magnet 312 is positioned between an outer surface layer 402 and an inner surface layer 404. In particular embodiments, the magnet 312 is positioned between the outer surface layer 402 and the inner surface layer 404 relative to a middle surface layer 406. For example, as depicted in FIG. 4B, the magnet 312 is positioned between the inner surface layer 404 and the middle surface layer 406. In certain embodiments, the magnet 312 abuts the inner surface layer 404.

The stitching 408 is also positioned adjacent to the magnet 312 to help maintain a position of the magnet 312. For example, the magnet 312 is positionally fixed in between the magnets 308-310.

Other suitable configurations fall within the scope of the present disclosure. For example, the magnet 312 can be positioned to linearly align (but not axially align) with the magnets 308-310. As another example, the magnet 312 can be positioned between the outer surface layer 402 and the middle surface layer 406.

Those of ordinary skill in the art will appreciate that the embodiments illustrated in FIGS. 4A-4B can be modified. For example, multiple middle layers 406 can be implemented in the hood collar 116 (e.g., to provide additional magnetic insulation between opposing sides of the hood collar 116). As another example, the middle layer 406 can be omitted all together.

Furthermore, those of ordinary skill in the art will appreciate that the outer surface layer 402, the inner surface layer 404, and the middle layer 406 can include a variety of materials disclosed herein. For example, in some embodiments, the outer surface layer 402, the inner surface layer 404, and the middle layer 406 can include a same material. In other embodiments, the outer surface layer 402, the inner surface layer 404, or the middle layer 406 can include different materials. To illustrate, in some embodiments, the outer surface layer 402 includes a first material (e.g., that corresponds to an outer shell of the detachable hood 104 and the jacket body 102), and the middle layer 406 includes a second material different from the first material.

Any of the features, components, and/or parts, including the arrangements and configurations thereof shown in FIGS. 4A-4B can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in 4A-4B.

As just mentioned, the jacket body 102 can include attachment mechanisms (e.g., quiet attachment mechanisms) at the jacket collar 106 for connecting with the detachable hood 104. In accordance with one or more such embodiments, FIG. 5 illustrates a front schematic view of a portion of an example jacket body.

Figure 5:
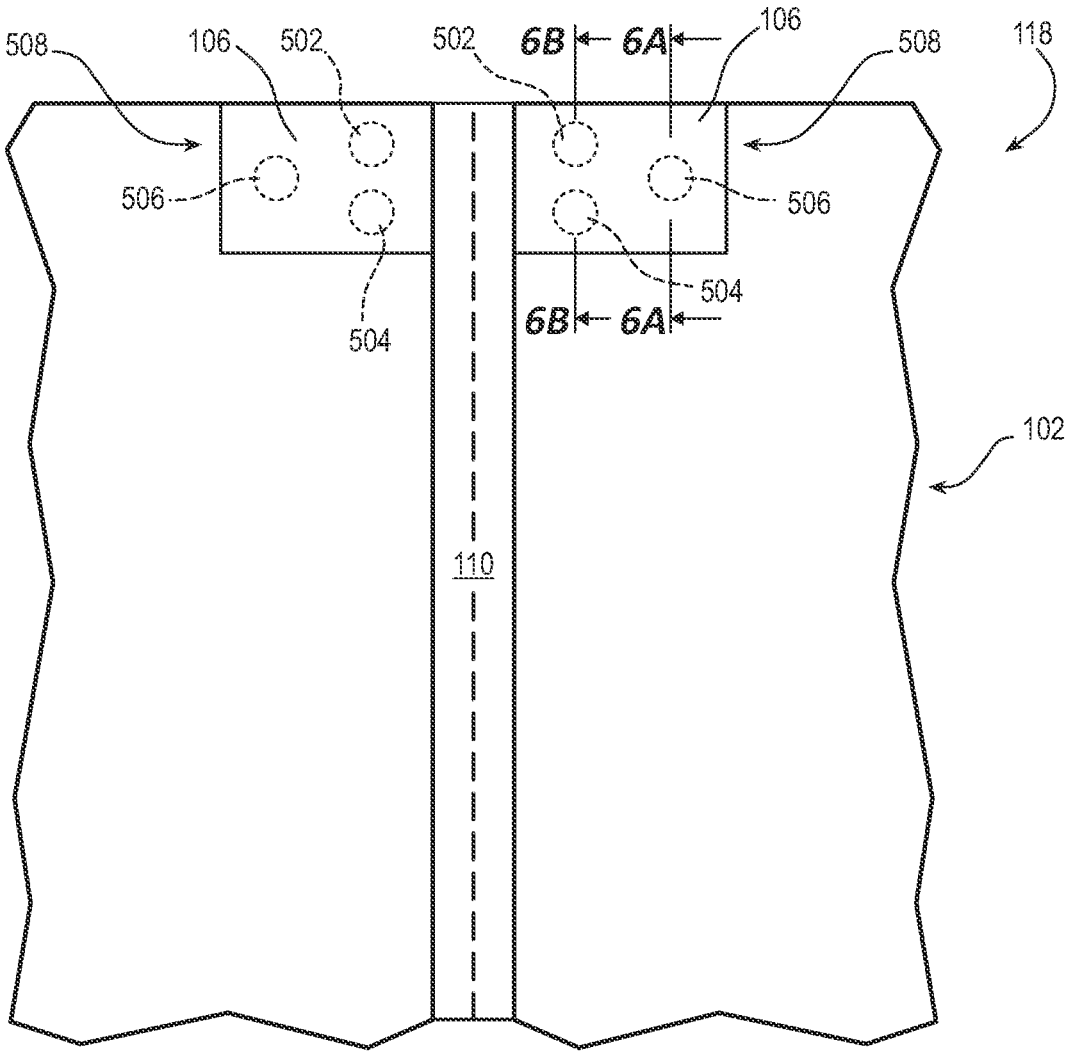
FIG. 5 illustrates a front schematic view of a portion of an example jacket body.

As shown in FIG. 5, the jacket collar 106 includes magnets 502-506. As similarly described above for the magnets 308-312 of the hood collar 116, the magnets 502-506 can be correspondingly sized, shaped, and interspaced. In particular, the magnets 502-506 can be arranged to engage the hood collar 116 upon insertion into a connection sleeve opening 508 disposed within the jacket collar 106. Specifically, adjacent to each side of the zipper 110 at the top end portion 118, the magnets 502-506 can be positioned on or within one or more sleeve sides of the jacket collar 106 defining the connection sleeve opening 508. Examples of positional configurations of the magnets 502-506 relative to particular layers of the sleeve sides are described further below in relation to FIGS. 6A-6B.

In at least some embodiments, the magnets 502-506 are not visible through the jacket collar 106 from a front view perspective. Additionally, as will be described more below in relation to FIG. 8, the connection sleeve opening 508 also conceals the hood collar 116 and associated magnets (or other quiet attachment mechanisms).

Although FIG. 5 illustrates the jacket collar 106 including three magnets, alternative embodiments of the jacket collar 106 can include more or fewer magnets. Likewise, the magnets 502-506 can include a different positional configuration (e.g., an "X" configuration, "T" configuration, etc.). It will be appreciated that various positional configurations can influence or provide one or more desired coupling/decoupling ergonomics (as will be described more below in relation to FIG. 7). Alternatively, as mentioned above, the hood collar 116 can include myriad different types of attachment mechanisms besides magnets.

Any of the features, components, and/or parts, including the arrangements and configurations thereof shown in FIG. 5 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 5.

Figure 6A:
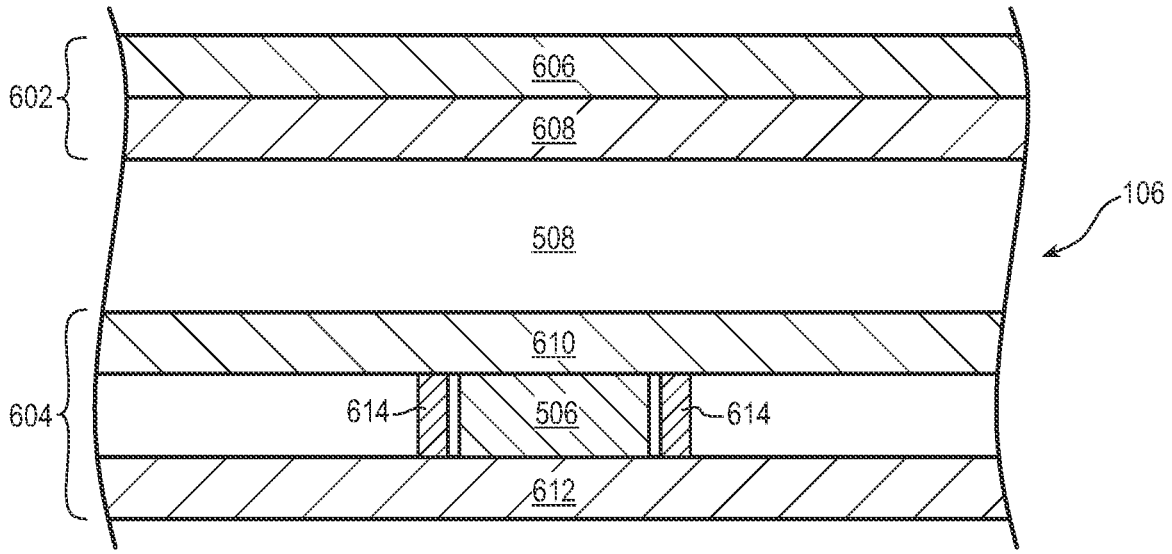
FIGS. 6A-6B illustrate cross-sectional views of an example jacket collar.
Figure 6B:
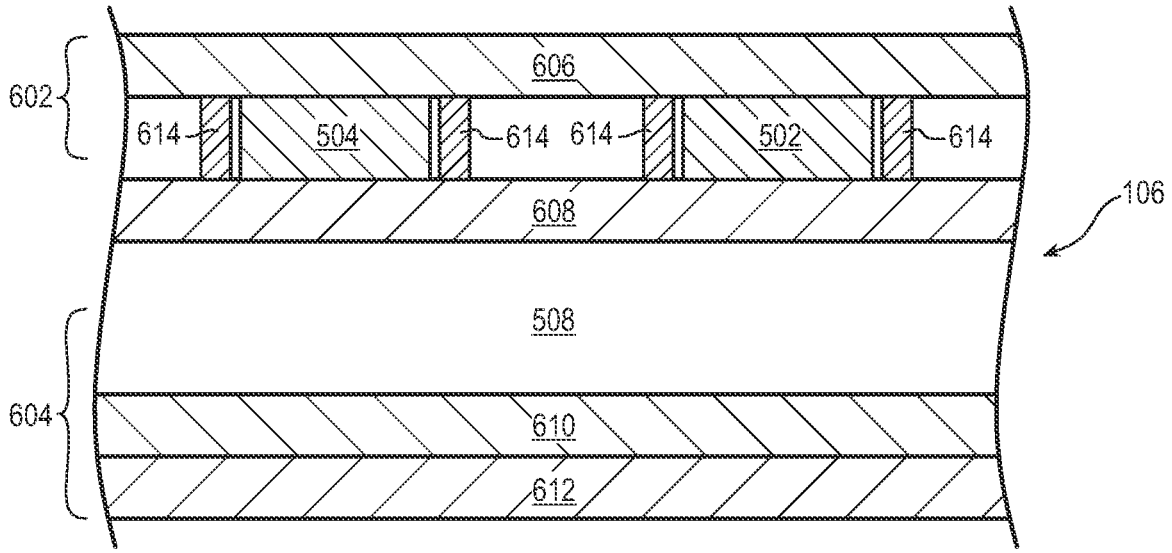

As mentioned above, the jacket collar 106 can include magnets on or between layers composing the jacket collar 106, particularly the connection sleeve opening 508. In accordance with one or more such embodiments, FIGS. 6A-6B illustrate cross-sectional views of an example jacket collar. In particular, FIG. 6A depicts a cross-section of the jacket collar 106 in a plane that dissects the jacket collar 106 perpendicular to the magnet 506.

As shown in FIG. 6A, the connection sleeve opening 508 is defined by a first sleeve side 602 and a second sleeve side 604. The first sleeve side 602 includes at least two layers of fabric, such as layers 606-608. Similarly, the second sleeve side 604 includes at least two layers of fabric, such as layers 610-612.

In one or more embodiments, the fabrics of the layers can include different fabric arrangements. In one example, the fabric of the layer 608 is the same as the fabric of the layer 610 (e.g., such that the connection sleeve opening 508 is lined by the same fabric). As another example, the layer 606 can correspond to an outer shell fabric for the jacket body 102. As another example, the layer 612 can correspond to an inner shell fabric lining at least a portion of the interior of the jacket body 102.

Other fabric configurations are also herein contemplated. Indeed, those of ordinary skill in the art will appreciate that the first sleeve side 602 and the second sleeve side 604 can include a variety of materials disclosed herein. For example, in some embodiments, the first sleeve side 602 and the second sleeve side 604 can include a same material. In other embodiments, the first sleeve side 602 and the second sleeve side 604 can include different materials. To illustrate, in some embodiments, one or more layers of the first sleeve side 602 include a first material (e.g., that corresponds to an outer shell of the detachable hood 104 and the jacket body 102), and one or more layers of the second sleeve side 604 include a second material different from the first material. Similarly, individual layers within the first sleeve side 602 (or the second sleeve side 604) can include the same or different materials, as may be desired.

In one or more embodiments, the magnet 506 is positioned on or within the second sleeve side 604. For example, the magnet 506 is embedded in the second sleeve side 604 between the layer 610 and the layer 612. In at least some embodiments, the magnet 506 is positioned centrally between the layer 610 and the layer 612 (e.g., about midway across the connection sleeve opening 508).

Further shown in FIG. 6A, stitching 614 is positioned adjacent to the magnet 506. As similarly described above, the stitching 614 can help maintain a position of the magnet 506 between the layers 610-612.

FIG. 6B depicts a cross-section of the jacket collar 106 in a plane that dissects the jacket collar 106 perpendicular to the magnets 502-504. At this particular cross-section, the magnets 502-504 are positioned on or within the first sleeve side 602. For example, the magnets 502-504 are embedded in the first sleeve side 602 between the layer 606 and the layer 608. In at least some embodiments, the magnets 502-504 are positioned between the layer 606 and the layer 608 at offset positions relative to each other and the magnet 506. For example, the magnets 502-504 are positioned at or near corners of the jacket collar 106 (e.g., adjacent to the zipper 110 not shown).

Alternative embodiments are also herein contemplated. For example, one or both of the magnets 502-504 can be embedded in the second sleeve side 604. As another example, the one or both of the magnets 502-504 can be positionally reconfigured or omitted.

In certain embodiments, magnets positioned between layers can provide a sound advantage. For example, one or more layers of the first sleeve side 602 and the second sleeve side 604 can provide a sound dampening effect when magnets snap together. That is, one or more layers of the first sleeve side 602 and the second sleeve side 604 can prevent the magnets from coming into intimate contact with each other, thereby causing increased noise upon coupling and/or decoupling the magnets.

Any of the features, components, and/or parts, including the arrangements and configurations thereof shown in FIGS. 6A-6B can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 6A-6B.

Figure 7:
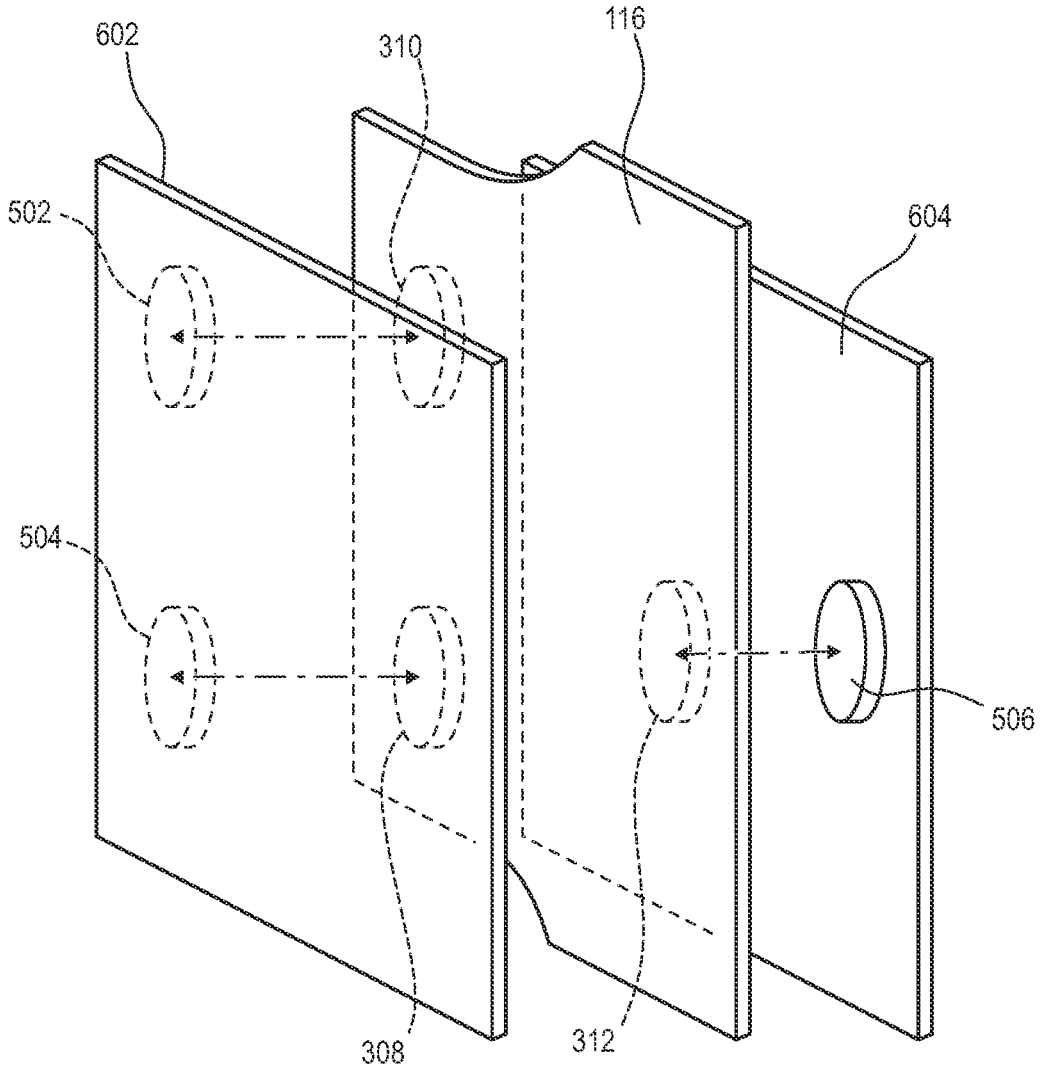
FIG. 7 illustrates a schematic exploded view of example connections between an example hood collar and an example jacket collar.

As just discussed, the jacket collar 106 and the hood collar 116 can include corresponding quiet attachment mechanisms for providing a removable connection therebetween. In accordance with one or more such embodiments, FIG. 7 illustrates a schematic exploded view of example connections between the hood collar 116 and the jacket collar 106.

In particular, the first sleeve side 602 of the jacket collar 106 discussed above includes the magnets 502-504. Further, the hood collar 116 includes the magnets 308-310. The magnet 502 is configured to removably attach to the magnet 310. Similarly, the magnet 504 is configured to removably attach to the magnet 308. In this manner, the hood collar 116 can connect to the first sleeve side 602 of the jacket collar 106.

From the opposing side, the second sleeve side 604 of the jacket collar 106 includes the magnet 506. The hood collar 116 further includes the magnet 312. The magnet 506 is configured to removably attach to the magnet 312.

By attaching the respective magnets of the hood collar 116 to the jacket collar 106 as just described, the hood collar 116 can be secured and concealed inside the connection sleeve opening 508 (not shown). In particular, the hood collar 116 is sandwiched in between the first sleeve side 602 and the second sleeve side 604. In this manner, the hood collar 116 is superimposed over the second sleeve side 604, but covered by the first sleeve side 602.

Alternative embodiments are also herein contemplated. For example, one of the first sleeve side 602 or the second sleeve side 604 can be omitted. In this example, the hood collar 116 can be superimposed over the first sleeve side 602 or the second sleeve side 604 (e.g., such that the hood collar 116 is not concealed by the jacket collar 106). As another example alternative embodiment, it will be appreciated that the magnet 506 can be embedded within the second sleeve side 604 as discussed above (albeit shown on the outside surface of the second sleeve side 604).

In one or more embodiments, the foregoing connections between the jacket collar 106 and the hood collar 116 can provide one or more desired ergonomics. For example, in some embodiments, the foregoing connections can be achieved utilizing a single hand. To illustrate, a connection between the magnet 312 and the magnet 506 can be achieved by positioning the magnet 312 in close proximity to and in axial alignment with the magnet 506. In this position, the magnetic attraction is sufficiently strong to bring the magnets 312, 506 together. As another example, a connection between the magnet 312 and the magnet 506 can be achieved by positioning the magnet 312 up to the magnet 506. In some cases, the magnetic forces can automatically align the magnets 312, 506 once in close proximity to each other.

With the removable connection formed between the magnets 312, 506, the other connections can likewise be formed. For example, using a pointer finger, a user can push the corners of the hood collar 116 into the connection sleeve opening 508 (not shown) such that the magnet 308 and the magnet 310 inevitably come into close proximity with the magnet 504 and the magnet 502, respectively. Once in close proximity, the magnets can quietly snap together.

In at least some embodiments, forming the connection between the magnets 312, 506 near the mouth of the connection sleeve opening 508 (not shown) can subsequently help align the other magnets near the back of the connection sleeve opening 508. That is, the magnets 502-504 may not be visible. However, the corresponding magnets of the hood collar 116 are positionally configured to align with the magnets 502-504 once the magnets 312, 506 are connected. Thus, first attaching the magnets 312, 506 can lend to convenient, quiet, and easy coupling of the hood collar 116 to the jacket collar 106 via the first sleeve side 602 and the second sleeve side 604.

Similarly, in some embodiments, the foregoing connections between the jacket collar 106 and the hood collar 116 can be decoupled in an ergonomic fashion. For example, in certain embodiments, a pulling motion (e.g., a single-handed pulling motion) can decouple the magnetic connections just described. To illustrate, the hood collar 116 or a portion of the detachable hood 104 can be grabbed and pulled out from inside the connection sleeve opening 508 between the first sleeve side 602 and the second sleeve side 604. In doing so, the pulling force can cause the magnets 308-312 to shear away from the magnets 502-506. Such an ergonomic, decoupling action can be done without visual perception of the magnetic connections. Likewise, the decoupling action can be quietly performed.

Other ergonomic coupling/decoupling actions are within the scope of the present disclosure. For example, depending on the type of quiet attachment mechanism, other ergonomic actions like finger presses, pinches, pushes, squeezes, taps, etc. can engage or disengage a quiet attachment mechanism. To illustrate, a hook and loop quiet attachment mechanism can be engaged and disengaged via a push-and-pull combination of the hood collar 116 (e.g., to push a hook past the loop and then pull back to connect into the loop).

Any of the features, components, and/or parts, including the arrangements and configurations thereof shown in FIG. 7 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 7.

Figure 8:
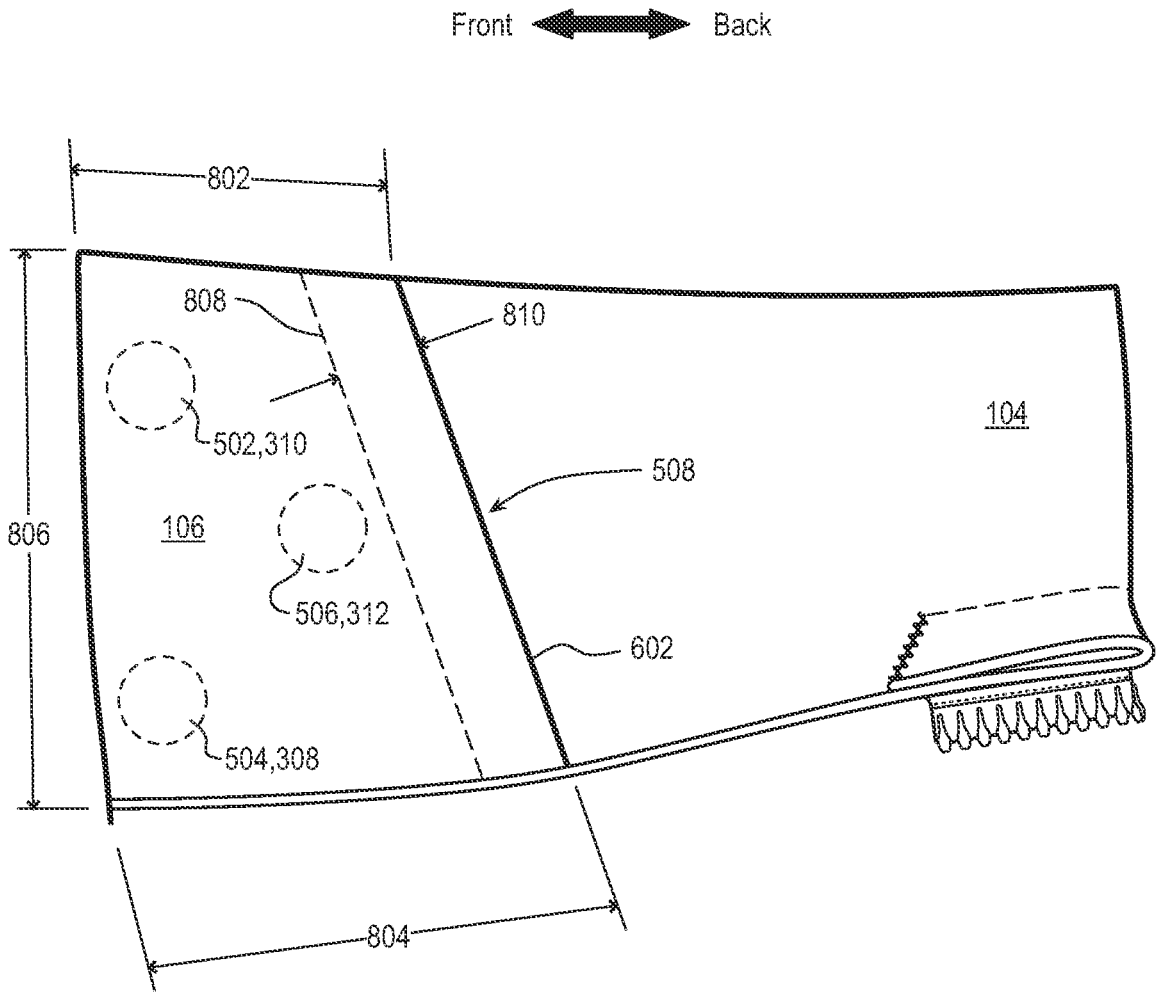
FIG. 8 illustrates an example connection between an example hood collar and an example jacket collar.

As just discussed, the hood collar 116 and the jacket collar 106 can join together in a convenient, removable fashion. In accordance with one or more such embodiments, FIG. 8 illustrates an example connection between the detachable hood 104 and the jacket collar 106. In particular, FIG. 8 shows the hood collar 116 of the detachable hood 104 inserted into the connection sleeve opening 508. Within the connection sleeve opening 508, the hood collar 116 is removably attached to the jacket collar 106 (e.g., via magnetic connections or couplings). Indeed, as described above, the magnets 502, 310 form a first removable connection. In addition, the magnets 504, 308 form a second removable connection, and the magnets 506, 312 form a third removable connection.

In one or more embodiments, the jacket collar 106 is sized and shaped to receive the hood collar 116. More particularly, the jacket collar 106 can be sized and shaped to conceal the hood collar 116 inside the connection sleeve opening 508, including the magnetic couplings between the hood collar 116 and the jacket collar 106. For example, the jacket collar 106 includes a top length 802, a bottom length 804, and a height 806. The top length 802, the bottom length 804, and the height 806 can include myriad different dimensions to cover or conceal the hood collar 116 inside the connection sleeve opening 508. To illustrate, the top length 802, the bottom length 804, and the height 806 can include dimensions ranging from about 0.5 inches to about ten inches. In particular embodiments, the top length 802, the bottom length 804, and the height 806 include dimensions ranging from about two inches to about eight inches. In at least some embodiments, the top length 802, the bottom length 804, and the height 806 include dimensions ranging from about three inches to about five inches.

Further shown in FIG. 8, the jacket collar 106 includes a seam 808 positioned at an offset distance 810 from the mouth of the connection sleeve opening 508. In one or more embodiments, the seam 808 corresponds to the location where a fabric of the jacket body 102 joins a fabric of the jacket collar 106 inside the connection sleeve opening 508. In certain embodiments, the fabric of the jacket body 102 differs from the fabric of the jacket collar 106 inside the connection sleeve opening 508. For example, the fabric of the jacket collar 106 inside the connection sleeve opening 508 can be a material resistant to wear and tear from the coupling action of the attachment mechanisms (e.g., magnets). Thus, in some embodiments, the seam 808 is positioned at the offset distance 810 from the mouth of the connection sleeve opening 508 so that the seam 808 and the fabric inside the connection sleeve opening 508 is concealed by the first sleeve side 602. That is, the first sleeve side 602 can overlap or cover the bottom fabric of the jacket collar 106 inside the connection sleeve opening 508, particularly when the detachable hood 104 is not attached to the jacket body 102.

Any of the features, components, and/or parts, including the arrangements and configurations thereof shown in FIG. 8 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 8.

Figure 9A:
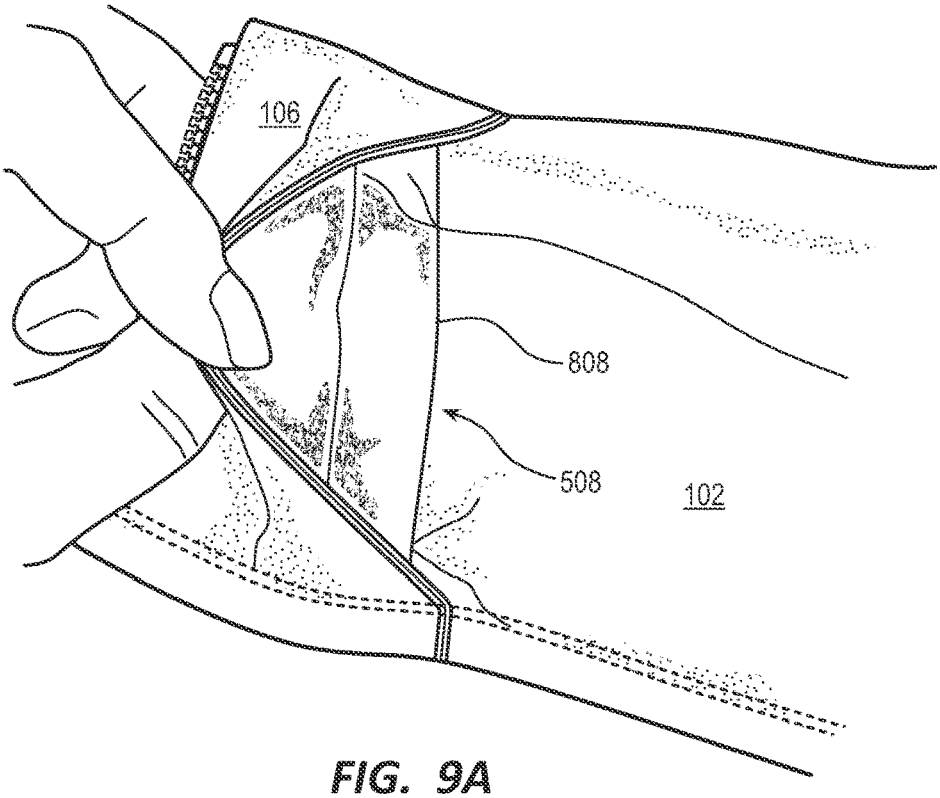
FIGS. 9A-9B illustrate a perspective view of an example hood collar being inserted into an example jacket collar.
Figure 9B:
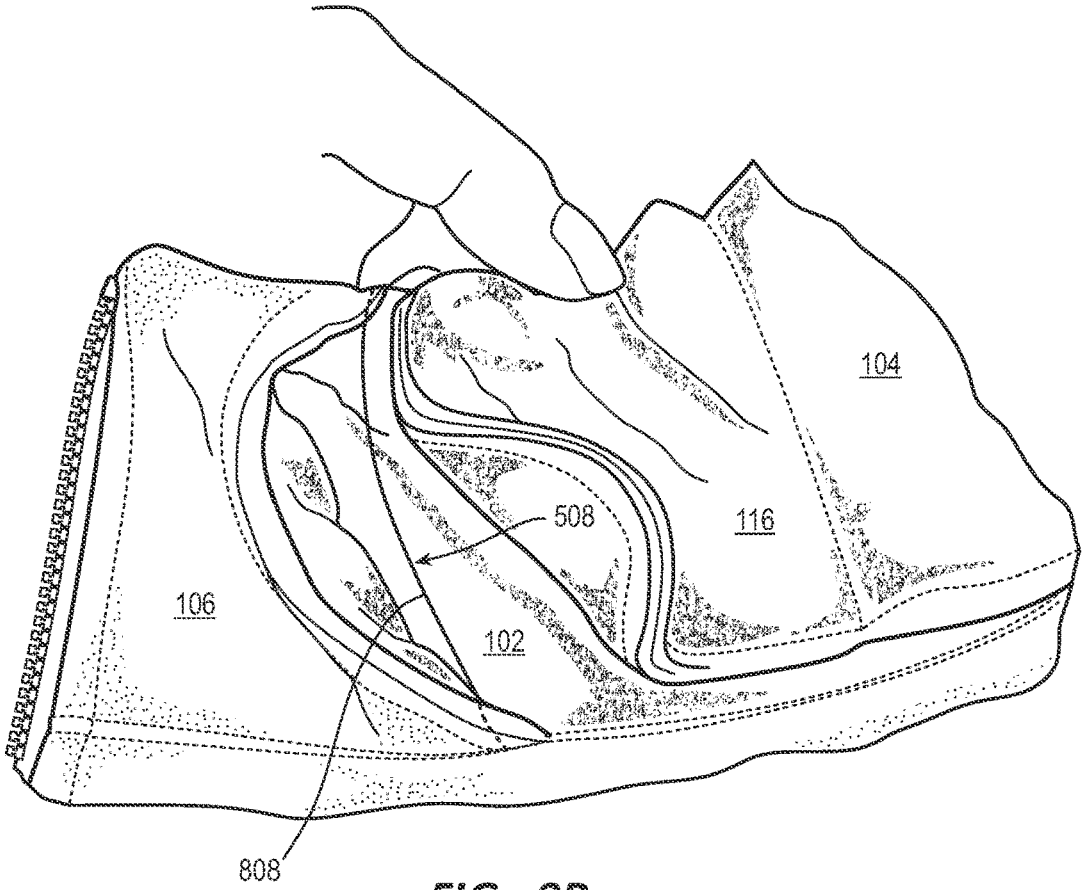

As mentioned above, the jacket body 102 and the detachable hood 104 can be quietly and conveniently coupled together. In particular, the hood collar 116 and the jacket collar 106 can be joined together via one or more attachment mechanisms. In accordance with one or more such embodiments, FIGS. 9A-9B illustrate a perspective view of the hood collar 116 being inserted into the jacket collar 106 of the jacket body 102. Specifically, FIG. 9A illustrates a portion of the jacket collar 106 being peeled back to expose the connection sleeve opening 508.

Then, in FIG. 9B, the hood collar 116 is depicted as being positioned up to the connection sleeve opening 508. A user finger can subsequently engage one or more attachment mechanisms (not shown) of the hood collar 116 and the jacket collar 106. For example, the user finger can position a magnet of the hood collar 116 in contact with (or within close proximity of) a corresponding magnet of the jacket collar 106 to achieve a magnetic coupling. Optionally, other attachment mechanisms can be similarly engaged (e.g., utilizing one or more ergonomic approaches as discussed above in relation to FIG. 7).

Any of the features, components, and/or parts, including the arrangements and configurations thereof shown in FIGS. 9A-9B can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 9A-9B.

As discussed above, the detachable hood 104 includes an adjustable hood tunnel 305. The adjustable hood tunnel 305 can provide various eye relief distances (e.g., for an increased field of view and/or reduced interference with certain objects in close proximity to facial features of a user). In accordance with one or more such embodiments, FIGS. 10A-10B illustrate a side view of an example removable hood with an adjustable hood tunnel.

Figure 10A:
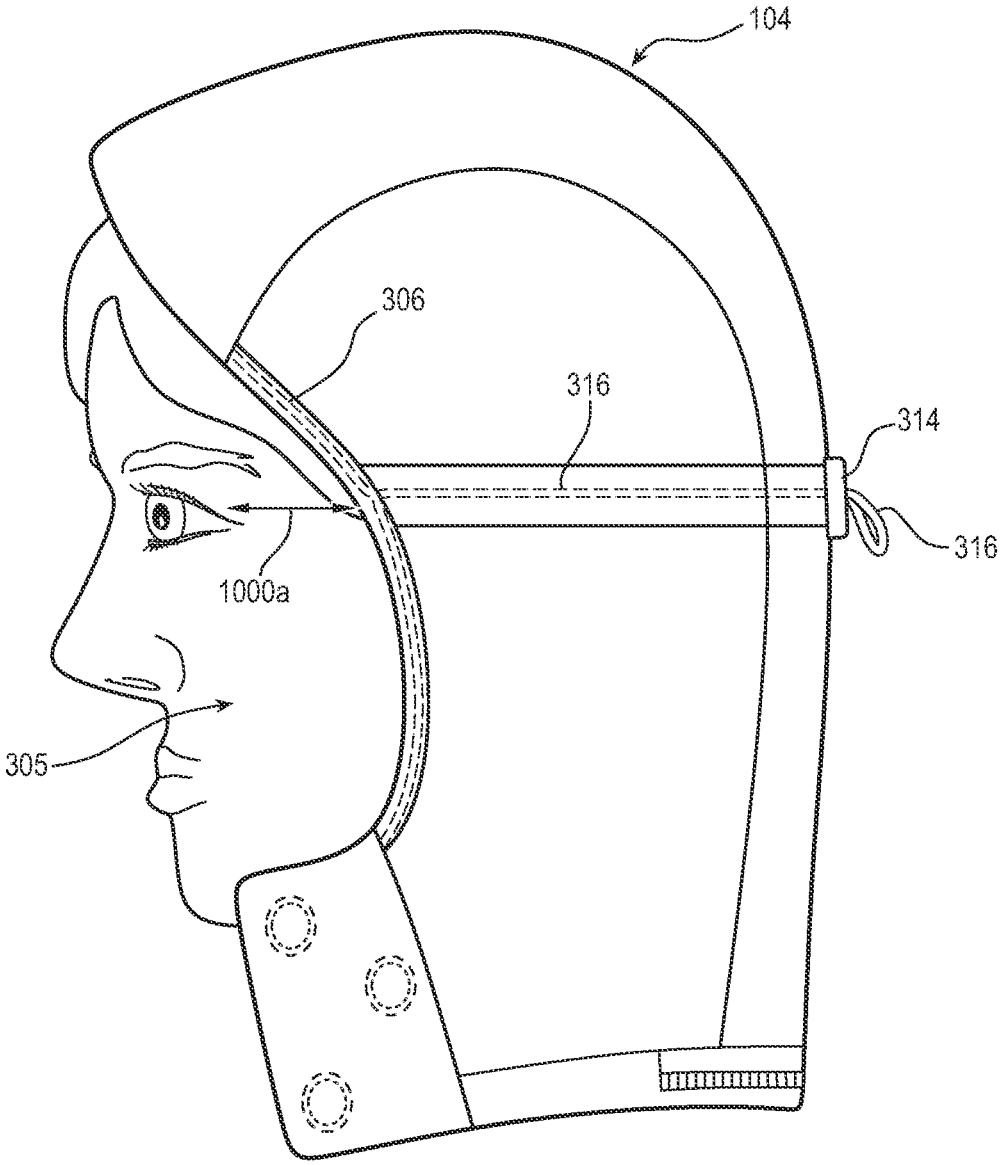
FIGS. 10A-10B illustrate a side view of an example removable hood with an adjustable hood tunnel.
Figure 10B:
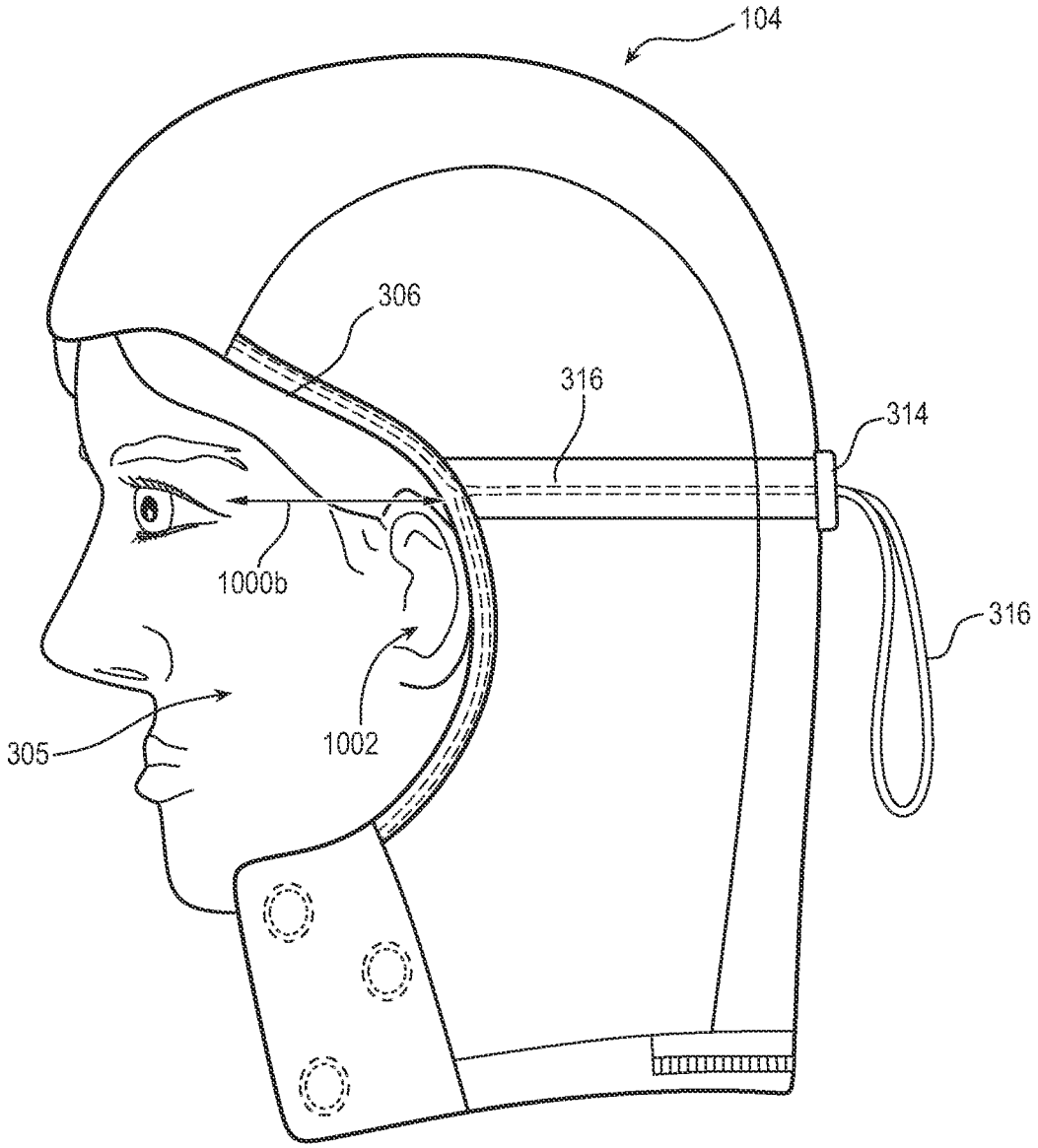

As shown in FIGS. 10A-10B, the detachable hood 104 includes the adjustment mechanism 314. As used herein, the term "adjustment mechanism" can include an actuator or locking mechanism. For example, the actuator can include one or more components that actuate component movement, electric (or digital) signals, fluid, sound, etc. to cause the side periphery 306 to retract or relax. For example, an actuator can include, for instance, linear actuators, rotary actuators, hydraulic actuators, pneumatic actuators, electric actuators, digital actuators, thermal actuators, magnetic actuators, mechanical actuators, supercoiled polymer actuators, etc. In addition, a locking mechanism can include one or more components for maintaining the side periphery 306 in the drawn (or non-drawn) state. In some embodiments, a locking mechanism includes a cord lock, mechanical stop, clamp, clasp, locking gear, etc.

Additionally shown, the drawstring 316 extends from the adjustment mechanism 314, to the side periphery 306, and along the side periphery 306. In some embodiments, the drawstring 316 includes a string, cord, wire, etc. The drawstring 316 can also include a flexible or stretchy material, as may be desired. In alternative embodiments (e.g., for different actuators as the adjustment mechanism 314), the drawstring 316 can be substituted for push-pull rods, circuitry, or other coupling between the actuator and the side periphery 306.

Unlike some conventional jackets that decrease a field of view when tightening portions of a hood, the detachable hood 104 disclosed herein includes the side periphery 306 that can change positions to increase an eye relief distance 1000*a* from the non-drawn state to an eye relief distance 1000*b* in the drawn state. As used herein, the term "eye relief distance" refers to a distance (e.g., linear distance) between the user eye and the side periphery 306 of the detachable hood 104.

In some embodiments, the drawstring 316 can be pulled or tensioned. The adjustment mechanism 314 can then hold the provided tension. In doing so, the drawstring 316 disposed within the detachable hood 104 (including the side periphery 306) can be pulled back toward the adjustment mechanism 314. In response, the side periphery 306 itself can be drawn away from the user eye to increase the lateral visible area or eye relief distance 1000*a* shown in FIG. 10A to the lateral visible area or eye relief distance 1000*b* shown in FIG. 10B. In one or more embodiments, the adjustable hood tunnel 305 in the drawn state exposes a user ear 1002, among other facial features such as an eye region, cheek region, etc.

Those of ordinary skill in the art will appreciate that such an increase in eye relief distance can advantageously improve a user's field of view and expose facial features while still donning the detachable hood 104. In close proximity hunting, for example, the improved field of view and exposed facial features allows a user to access and use rangefinder or firearm optics brought in close proximity to the user eyes without inhibition of the detachable hood 104. Likewise, a user can draw an archery bow and, in the process, bring a bow string back in full draw to abut or rest against a user's cheek, aim at the target, and release the bowstring without interference from any portion of the detachable hood 104. In contrast, hoods of conventional jackets are often bulky and cumbersome and, as such, cannot effectively be worn by bowhunters participating in close proximity hunting-due to the reduced field of view and extra material and bulkiness of the material.

Modifications, additions, or omissions to the embodiments illustrated in FIGS. 10A-10B are herein contemplated. As an example, the adjustment mechanism 314 can include a rotatable boa winding, and the drawstring 316 can include a wire.

Any of the features, components, and/or parts, including the arrangements and configurations thereof shown in FIGS. 10A-10B can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 10A-10B.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed.

It will be apparent to one of ordinary skill in the art that many modifications and variations are possible in view of the above teachings. Indeed, various inventions have been described herein with reference to certain specific aspects and examples. However, they will be recognized by those skilled in the art that many variations are possible without departing from the scope and spirit of the inventions disclosed herein. Specifically, those inventions set forth in the claims below are intended to cover all variations and modifications of the inventions disclosed without departing from the spirit of the inventions. The terms "including" or "includes" as used in the specification shall have the same meaning as the term "comprising."

What is claimed is:

1. A jacket, comprising:

a jacket body comprising:

a first connection sleeve and a second connection sleeve; and a detachable hood connected to the jacket body, the detachable hood comprising:

a top dome portion; a back portion connected to the top dome portion;

a first side portion connected to the top dome portion and the back portion, the first side portion defining a first side periphery;

a second side portion opposing the first side portion, the second side portion connected to the top dome portion and the back portion, the second side portion defining a second side periphery; and a first collar flap and a second collar flap respectively connected to the first side portion and the second side portion, the first collar flap and the second collar flap respectively abutting lower portions of the first side periphery and the second side periphery, and the first collar flap and the second collar flap each comprising a magnetic connector to connect to the jacket body, wherein the first collar flap and the second collar flap respectively extend forward relative to the first side portion and the second side portion;

wherein the first collar flap and the second collar flap respectively extend forward relative to the lower portions of the first side periphery and the second side periphery; and wherein, when the first collar flap and the second collar flap are brought toward each other to at least partially enclose a hood opening, and an end portion of the first collar flap and an end portion of the second collar flap are concealed within the first and second connection sleeves, respectively.

2. The jacket of claim 1, wherein the first collar flap and the second collar flap respectively comprise an outer surface layer and an inner surface layer opposing the outer surface layer, the magnetic connector in each of the first collar flap and the second collar flap being respectively embedded in the first collar flap and the second collar flap between the outer surface layer and the inner surface layer.

3. The jacket of claim 2, wherein the first collar flap and the second collar flap each comprise a middle layer disposed between the outer surface layer and the inner surface layer.

4. The jacket of claim 3, wherein the magnetic connector in each of the first collar flap and the second collar flap is positioned:

entirely between the outer surface layer and the middle layer; or entirely between the inner surface layer and the middle layer.

5. The jacket of claim 3, wherein:

the first collar flap and the second collar flap each comprise an additional magnetic connector positioned entirely between the inner surface layer and the middle layer; and the magnetic connector in each of the first collar flap and the second collar flap is positioned entirely between the outer surface layer and the middle layer.

6. The jacket of claim 1, wherein:

the magnetic connector in each of the first collar flap and the second collar flap is positioned at the end portion of the first collar flap and the end portion of the second collar flap, respectively; and the first collar flap and the second collar flap each comprise an additional magnetic connector positioned at a portion opposite to the end portion of the first collar flap and a portion opposite to the second collar flap, respectively.

7. The jacket of claim 1, wherein the magnetic connector in each of the first collar flap and the second collar flap comprises a plurality of magnetic connectors spaced equidistant from each other in the first collar flap and the second collar flap.

8. The jacket of claim 1, wherein the first side periphery and the second side periphery define an adjustable hood tunnel.

9. The jacket of claim 8, further comprising:

a drawstring lock positioned at the back portion or the top dome portion; and a drawstring connecting the first side periphery and the second side periphery to the drawstring lock.

10. The jacket of claim 9, wherein:

the adjustable hood tunnel forms a first eye relief distance when the drawstring and the drawstring lock are configured in a non-drawn state; and the adjustable hood tunnel forms a second eye relief distance greater than the first eye relief distance when the drawstring and the drawstring lock are configured in a drawn state.

11. The jacket of claim 1, wherein the jacket body and the detachable hood include a material comprising at least one of wool, fleece, or polyester.

12. The jacket of claim 1, wherein the first collar flap and the second collar flap are configured for decoupling from the jacket body using a single-handed pulling motion.

13. The jacket of claim 1, wherein the jacket body comprises:

a jacket body top area;

a jacket body bottom area; and a zipper extending at least partially between the jacket body top area and the jacket body bottom area, the first connection sleeve and the second connection sleeve being positioned adjacent to the zipper at the jacket body top area.

14. The jacket of claim 1, wherein the jacket body comprises arm sleeves.

15. The jacket of claim 1, wherein the detachable hood is configured for removal from the jacket body while the jacket is worn.

16. The jacket of claim 1, wherein the detachable hood is configured for at least one of coupling to or decoupling from the jacket body under a threshold decibel level.

17. The jacket of claim 1, wherein the jacket body comprises one or more pockets comprising an internal pocket positioned within the one or more pockets and the internal pocket is sized and shaped to receive a warming element.

18. The jacket of claim 17, wherein the internal pocket is oriented in a different direction than the one or more pockets.

19. A jacket, comprising:

a jacket body comprising a first connection sleeve and a second connection sleeve; and a detachable hood connected to the jacket body, the detachable hood comprising:

a top dome portion;

a back portion connected to the top dome portion;

a first side portion connected to the top dome portion and the back portion, the first side portion defining a first side periphery;

a second side portion opposing the first side portion, the second side portion connected to the top dome portion and the back portion, the second side portion defining a second side periphery; and a first collar flap and a second collar flap respectively connected to the first side portion and the second side portion, the first collar flap and the second collar flap respectively abutting lower portions of the first side periphery and the second side periphery, and the first collar flap and the second collar flap each comprising an attachment mechanism to connect to the jacket body, wherein the first collar flap and the second collar flap respectively extend forward relative to the first side portion and the second side portion;

wherein the first collar flap and the second collar flap respectively extend forward relative to the lower portions of the first side periphery and the second side periphery; and wherein, when the first collar flap and the second collar flap are brought toward each other to at least partially enclose a hood opening, and an end portion of the first collar flap and an end portion of the second collar flap are concealed within the first connection sleeve and the second connection sleeves, respectively.

20. The jacket of claim 19, wherein the attachment mechanism includes a noise-reducing modification comprising at least one of an added material, a coating, or a dampener.

* * * * *